US012662724B2

(12) United States Patent
Takenaka et al.

(10) Patent No.: US 12,662,724 B2
(45) Date of Patent: Jun. 23, 2026

(54) METHOD FOR PRODUCING GRAIN-ORIENTED ELECTRICAL STEEL SHEET

(71) Applicant: JFE Steel Corporation, Tokyo (JP)

(72) Inventors: Masanori Takenaka, Tokyo (JP); Takeshi Imamura, Tokyo (JP); Takaaki Tanaka, Tokyo (JP); Hiroi Yamaguchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 401 days.

(21) Appl. No.: 18/564,171

(22) PCT Filed: May 26, 2022

(86) PCT No.: PCT/JP2022/021550
§ 371 (c)(1),
(2) Date: Nov. 27, 2023

(87) PCT Pub. No.: WO2022/250112
PCT Pub. Date: Dec. 1, 2022

(65) Prior Publication Data

US 2024/0247347 A1 Jul. 25, 2024

(30) Foreign Application Priority Data

May 28, 2021 (JP) ..... 2021-090438

(51) Int. Cl.
*C22C 38/02* (2006.01)
*C21D 3/04* (2006.01)
(Continued)

(52) U.S. Cl.
CPC ..... *C22C 38/02* (2013.01); *C21D 3/04* (2013.01); *C21D 6/008* (2013.01); *C21D 8/1205* (2013.01);
(Continued)

(58) Field of Classification Search
CPC ..... C22C 38/02; C22C 38/001; C22C 38/04; C22C 38/06; C22C 38/60; C21D 3/04;
(Continued)

(56) References Cited

U.S. PATENT DOCUMENTS 4,588,453 A 5/1986 Shimizu et al.
5,074,931 A 12/1991 Mochinaga et al.
(Continued)

FOREIGN PATENT DOCUMENTS

CN 1958812 A 5/2007
CN 107429307 A 12/2017
(Continued)

OTHER PUBLICATIONS

The extended European Search Report issued Oct. 11, 2024, by the European Patent Office in corresponding European Patent Application No. 22811382.5-1103. (15 pages).
(Continued)

*Primary Examiner* — Ricardo D Morales
(74) *Attorney, Agent, or Firm* — Buchanan Ingersoll & Rooney PC

(57) ABSTRACT

In the production of a grain-oriented electrical steel sheet by heating a steel slab containing, in mass %, C: 0.02 to 0.10%, Si: 2.5 to 5.5%, Mn: 0.01 to 0.30%, S: 0.0010 to 0.040%, Se: 0 to 0.040%, sol. Al: 0.010 to 0.040%; and N: 0.004 to 0.020% to 1300° C. or higher; subsequently performing hot rolling, hot-band annealing as necessary, cold rolling, and primary recrystallization annealing which also serves as decarburization annealing; applying an annealing separator on the surface of the steel sheet; and performing finishing annealing, edge cracks that may occur in the hot rolling are effectively prevented by keeping a slab lateral face temperature at a time of starting rough rolling during the hot rolling equal to or lower than a temperature $T_e$ defined by the
(Continued)

following Expression $T_e$=−120000 [% S]$^2$+1400 (1) and carrying out width reduction after at least one pass in the rough rolling.

8 Claims, 1 Drawing Sheet

(51) Int. Cl.

| | |
|---|---|
| ***C21D 6/00*** | (2006.01) |
| ***C21D 8/1205*** | (2026.01) |
| ***C21D 8/1216*** | (2026.01) |
| ***C21D 8/1244*** | (2026.01) |
| ***C21D 8/1277*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/60*** | (2006.01) |

(52) U.S. Cl.
CPC ..... *C21D 8/1222* (2013.01); *C21D 8/1233* (2013.01); *C21D 8/1255* (2013.01); *C21D 8/1266* (2013.01); *C21D 8/1272* (2013.01); *C21D 8/1283* (2013.01); *C21D 9/46* (2013.01); *C22C 38/001* (2013.01); *C22C 38/04* (2013.01); *C22C 38/06* (2013.01); *C22C 38/60* (2013.01); *C21D 2201/05* (2013.01)

(58) Field of Classification Search
CPC .... C21D 6/008; C21D 8/1205; C21D 8/1222; C21D 8/1233; C21D 8/1255; C21D 8/1266; C21D 8/1272; C21D 8/1283; C21D 9/46; C21D 2201/05; C21D 1/26; C21D 8/0268; C21D 1/76; C21D 8/1261; H01F 1/147; H01F 1/16; H01F 41/02; Y02P 10/20
See application file for complete search history.

(56) References Cited

U.S. PATENT DOCUMENTS

| | | | |
|---|---|---|---|
| 2018/0282830 | A1 | 10/2018 | Tada et al. |
| 2020/0325555 | A1 | 10/2020 | Takenaka et al. |
| 2022/0195555 | A1 | 6/2022 | Ehashi et al. |

FOREIGN PATENT DOCUMENTS

| | | | | |
|---|---|---|---|---|
| EP | 3 733 895 | A1 | | 11/2020 |
| JP | 4015644 | | | 7/1965 |
| JP | 5113469 | | | 4/1976 |
| JP | 5431024 | A | | 3/1979 |
| JP | 5562124 | A | | 5/1980 |
| JP | 5824397 | | | 5/1983 |
| JP | 60145204 | A | | 7/1985 |
| JP | 60145318 | A | | 7/1985 |
| JP | 60190520 | A | | 9/1985 |
| JP | 60200916 | A | | 10/1985 |
| JP | 613837 | A | | 1/1986 |
| JP | 6171104 | A | | 4/1986 |
| JP | 62196328 | A | | 8/1987 |
| JP | 0347601 | A | | 2/1991 |
| JP | H0347601 | A | * | 2/1991 |
| JP | H03-087316 | A | | 4/1991 |
| JP | 03133501 | A | | 6/1991 |
| JP | 03243244 | A | | 10/1991 |
| JP | 04157118 | A | | 5/1992 |
| JP | 05138207 | A | | 6/1993 |
| JP | 2001-279328 | A | | 10/2001 |
| JP | 2006-075885 | A | | 3/2006 |
| JP | 2009012033 | A | | 1/2009 |
| KR | 1999-0053871 | A | | 7/1999 |
| WO | 2020/218329 | A1 | | 10/2020 |

OTHER PUBLICATIONS

International Search Report and Written Opinion for International Application No. PCT/JP2022/021550, dated Aug. 9, 2022, 5 pages.
Office Action (The First Office Action) issued Oct. 24, 2025, by the State Intellectual Property Office of People's Republic of China in corresponding Chinese Patent Application No. 202280037045.9 and an English translation of the Office Action. (18 pages).

* cited by examiner

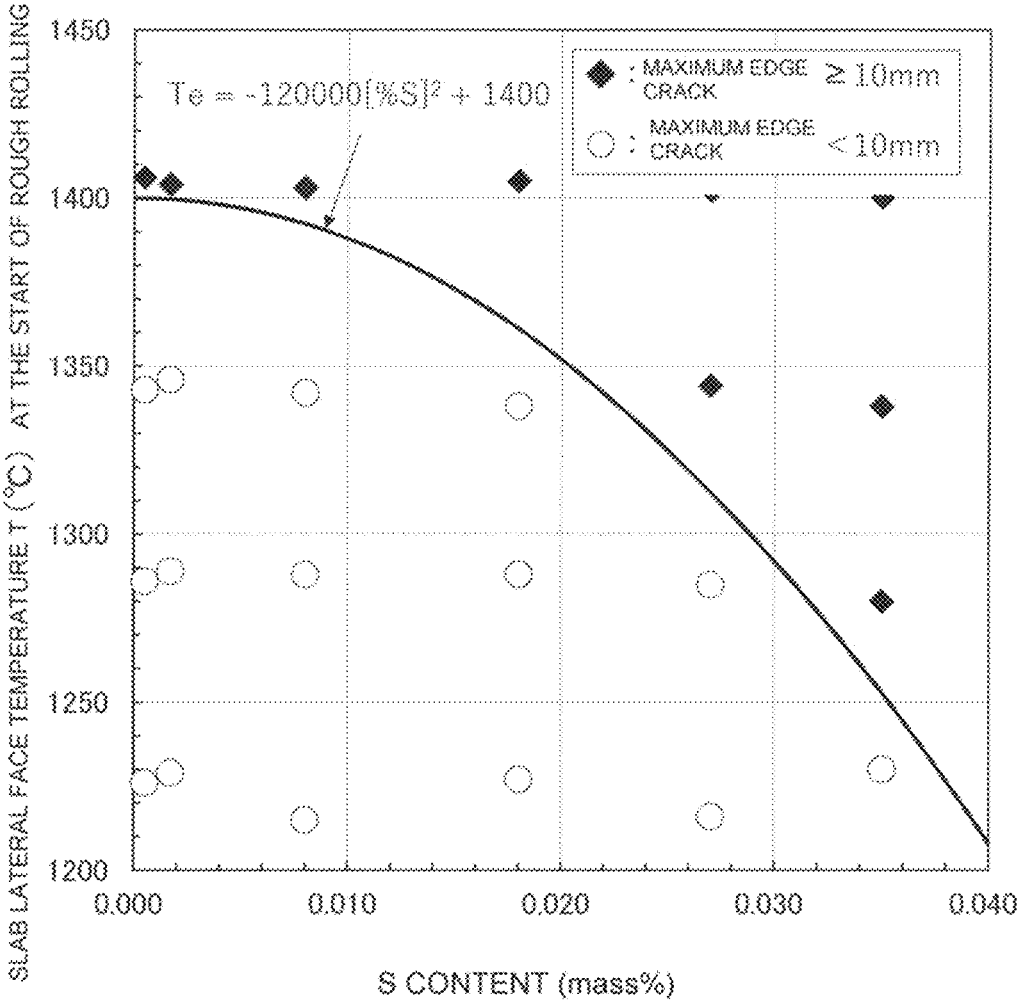
SLAB LATERAL FACE TEMPERATURE T (℃) AT THE START OF ROUGH ROLLING
1450
1400
1350
1300
1250
1200
0.000
0.010
0.020
0.030
0.040
S CONTENT (mass%)
Te = -120000[%S]² + 1400
: MAXIMUM EDGE CRACK ≥ 10mm
: MAXIMUM EDGE CRACK < 10mm

METHOD FOR PRODUCING GRAIN-ORIENTED ELECTRICAL STEEL SHEET

CROSS REFERENCE TO RELATED APPLICATIONS

This is the U.S. National Phase application of PCT/JP2022/021550, filed May 26, 2022, which claims priority to Japanese Patent Application No. 2021-090438, filed May 28, 2021, the disclosures of these applications being incorporated herein by reference in their entireties for all purposes.

FIELD OF THE INVENTION

The present invention relates to a method for producing a so-called grain-oriented electrical steel sheet in which crystal grains are highly integrated into the {110} orientation on the sheet surface and in the <001> orientation in the rolling direction, in terms of miller indices.

BACKGROUND OF THE INVENTION

Grain-oriented electrical steel sheets are soft magnetic materials and are widely used mainly as iron cores of electrical devices such as transformers. These grain-oriented electrical steel sheets exhibit excellent magnetic properties, such as low iron loss and high magnetic flux density, which is caused by the crystal grains highly integrated into the {110}<001> orientation (hereinafter, "Goss orientation") by using secondary recrystallization. Indicators for evaluation of magnetic properties of grain-oriented electrical steel sheets generally used include a magnetic flux density $B_8$ (T) at a magnetic field intensity of 800 (A/m), and an iron loss $W_{17/50}$ per kilogram of a steel sheet (W/kg) caused by magnetization up to 1.7 (T) in an alternating current magnetic field at an excitation frequency of 50 (Hz).

A method for producing such a grain-oriented electrical steel sheet generally used involves preferentially growing Goss-oriented grains by causing fine precipitates called an inhibitor to precipitate in final finishing annealing, which provides mobility differences to crystal grain boundaries. For example, Patent Literature 1 discloses a method using an inhibitor such as AlN and MnS, whereas Patent Literature 2 discloses a method using an inhibitor such as MnS and MnSe, both of which have industrially been put into practical use. These methods using the inhibitor are ideally conducted under a state where the inhibitors are finely and uniformly dispersed. To that effect, it is considered necessary to heat a steel slab that serves as a material to a high temperature of 1300° C. or higher before performing hot rolling.

In this regard, heating a slab at a high temperature for a long period leads to a problem of coarsening the crystal texture, which promotes non-uniformity of the texture. To cope with this problem, a method that heats a slab to a high temperature of approximately 1300° C. to 1450° C. in a short time, as disclosed in Patent Literature 3, is becoming mainstream. Examples of the slab heating method include induction heating and electric heating disclosed in Patent Literature 4 and Patent Literature 5. This technique not only makes it possible to prevent the coarsening of the crystal texture but also allows the slabs to be processed individually, which increases the flexibility of hot rolling opportunities, resulting in benefits for production efficiency, equipment construction costs, and maintenance/management costs.

However, as using short-time rapid heating, the heating method described above is apt to cause uneven heating depending on the position in the slab and non-uniform heating temperature. Moreover, ingredients that can easily have microsegregation, such as inhibitor-forming ingredients, may not be distributed with sufficient uniformity. This may cause a drawback in that the magnetic properties of the products are varied in the width direction or the longitudinal direction of the coils.

Grain-oriented electrical steel sheets have been strongly demanded not only to improve the variation in the magnetic properties described above but also to supply products at a lower price. Thus, it is an important issue for producers to produce high-quality products with an improved yield. The solutions for increasing the yield include, for example, preventing an edge crack caused in a steel sheet edge part at the time of hot rolling.

Many techniques have been proposed to prevent such an edge crack in hot rolling. For example, Patent Literature 6 discloses a method in which, in a hot rolling step performed on a continuously casted slab for a unidirectional grain-oriented silicon steel sheet, the difference between a finishing rolling start temperature and a finishing rolling end temperature (i.e., the temperature decrease during the finishing rolling) is set 220° C. or lower. However, even when the difference between the start temperature and the end temperature of the finishing rolling is regulated to be within such a range, it is impossible to prevent an edge crack that occurs in rough rolling or at stages before the finishing rolling.

Patent Literature 7 to 11 each disclose a method for hot rolling grain-oriented silicon steel that prevents an edge crack by adjusting the shapes of lateral faces of a sheet bar in hot rolling. Patent Literature 12 proposes a method for regulating the final rolling reduction in hot rough rolling. Patent Literature 13 proposes a method for conducting width reduction and horizontal rolling reduction after heating a slab. Patent Literature 14 proposes a method for controlling the texture of a cast slab. Patent Literature 15 proposes a method for arranging the cross-sectional shape of a slab to be a special shape.

PATENT LITERATURE

Patent Literature 1: JP-B-S40-015644
Patent Literature 2: JP-B-S51-013469
Patent Literature 3: JP-A-S60-190520
Patent Literature 4: Japanese Utility Model Publication No. 58-024397
Patent Literature 5: JP-A-S60-145318
Patent Literature 6: JP-A-S55-062124
Patent Literature 7: JP-A-S60-145204
Patent Literature 8: JP-A-S60-200916
Patent Literature 9: JP-A-S61-071104
Patent Literature 10: JP-A-S62-196328
Patent Literature 11: JP-A-H05-138207
Patent Literature 12: JP-A-S54-031024
Patent Literature 13: JP-A-H03-133501
Patent Literature 14: JP-A-H03-243244
Patent Literature 15: JP-A-S61-003837

SUMMARY OF THE INVENTION

The techniques proposed in Patent Literature 7 to 11 listed above aim to prevent an edge crack by carrying out width reduction on the entry side of finishing rolling to adjust the shapes of the lateral faces, based on the knowledge that when the shape of the lateral faces of a slab is poor, a notch-formed concave portion appears in a grain boundary part of crystals that have grown coarsened due to the high-temperature heating for the slab, and the concave portion becomes a starting point of an edge crack. This method is more effective in preventing an edge crack than other methods that perform width reduction on the exit side of finishing rolling but has yet to eliminate the edge crack. The techniques proposed in Patent Literature 12 to 15 are also effective against an edge crack to some extent but do not eliminate the occurrence of the edge crack.

Aspects of the present invention were made in view of the problems of the conventional techniques described above and aim to propose a technique capable of effectively preventing an edge crack that appears in hot rolling in a method for producing a grain-oriented electrical steel sheet that uses AlN and MnS, and optionally MnSe, as an inhibitor.

The present inventors intensively studied to solve the abovementioned problems by focusing on the cause of the edge crack. As a result, we have discovered that, in most cases, an edge crack occurs at the rough rolling stage of the hot rolling process, and that the main cause of the edge crack is a liquid phase part being locally formed due to S forming a low melting point phase. We accordingly found that, to prevent the edge crack, it is effective to appropriately manage slab surface temperature from the slab heating to the start of the hot rough rolling in accordance with the S content in the slab and to also start the hot rough rolling at an appropriate slab lateral face temperature, and finally developed the present invention.

Aspects of the present invention based on the above knowledge propose a method for producing a grain-oriented electrical steel sheet characterized by including:

heating a steel slab having an ingredient composition containing C: 0.02 to 0.10 mass %, Si: 2.5 to 5.5 mass %, Mn: 0.01 to 0.30 mass %, S: 0.0010 to 0.040 mass %, Se: 0 to 0.040 mass %, sol. Al: 0.010 to 0.040 mass %, and N: 0.004 to 0.020 mass % with a remaining part comprising Fe and inevitable impurities;

hot rolling the slab;

subjecting the hot-rolled sheet to, optionally, hot-band annealing and then to one cold rolling or two or more cold rollings with an intermediate annealing between each cold rolling to form a cold-rolled sheet with a final sheet thickness;

subjecting the cold-rolled sheet to primary recrystallization annealing which also serves as decarburization annealing;

applying an annealing separator to the steel sheet surface; and subjecting the sheet to finishing annealing, wherein the slab is heated to 1300° C. or higher;

a slab lateral face temperature T when starting rough rolling during the hot rolling is equal to or lower than a temperature $T_e$ defined by Expression (1) presented below, $$T_e = -120000\,[\%\ S]^2 + 1400 \quad (1)$$

where [% S] denotes a S content (mass %) in the slab; and width reduction is carried out after at least one pass in the rough rolling.

According to the method for producing a grain-oriented electrical steel sheet according to aspects of the present invention, the slab is heated until the slab surface temperature reaches a temperature of 1100 to 1300° C., held at the temperature for 0 to 300 min, cooled with a decrease amount in the slab surface temperature in the range of 50 to 200° C., heated until the slab surface temperature to 1300° C. or higher at a heating rate of 100° C./hr or more, and held at the temperature for 0 to 180 min.

The method for producing a grain-oriented electrical steel sheet according to aspects of the present invention is also characterized by including:

a hot rolling step including heating a steel slab, performing rough rolling of one or more passes in a temperature range from 1100° C. to the above-described $T_e$, performing finishing rolling of two or more passes in a temperature range from 800 to 1300° C. to obtain a hot-rolled sheet, and winding the sheet into a coil at a winding temperature of 400 to 750° C.;

optionally, a hot-band annealing step including holding the hot-rolled sheet at a temperature from 800 to 1250° C. for 5 seconds or longer and then cooling the sheet from 800 to 350° C. at a rate of 5 to 100° C./s;

a cold rolling step including one cold rolling performed so that a total rolling reduction falls within the range of 50 to 92%, or including two or more cold rollings performed so that a total rolling reduction at the final cold rolling for obtaining the final sheet thickness falls within the range of 50 to 92%;

optionally, an intermediate annealing step including holding the sheet at a temperature from 800 to 1250° C. for 5 seconds or longer and then cooling the sheet from 800 to 350° C. at a rate of 5 to 100° C./s;

a primary recrystallization annealing step serving as decarburization annealing including holding the sheet at a temperature from 750 to 950° C. for 10 seconds or longer under a wet atmosphere containing $H_2$ and $N_2$ and having a dew point of 20 to 80° C.;

an annealing separator applying step including applying an annealing separator mainly composed of MgO to a surface of the steel sheet in an amount of 3 g/m$^2$ or more per surface; and a finishing annealing step that includes purification where the sheet is held at a temperature of 1050° C. to 1300° C. for 3 hours or longer and that uses an $H_2$-containing atmosphere for a part of a temperature range of 800° C. or higher including at least the purification.

The method for producing a grain-oriented electrical steel sheet according to aspects of the present invention is characterized in that the steel slab to be used contains, in addition to the above ingredient composition, at least one selected from the group consisting of Ni: 0 to 1.00 mass %, Sb: 0 to 0.50 mass %, Sn: 0 to 0.50 mass %, Cu: 0 to 0.50 mass %, Cr: 0 to 0.50 mass %, P: 0 to 0.50 mass %, Mo: 0 to 0.50 mass %, Nb: 0 to 0.020 mass %, V: 0 to 0.010 mass %, B: 0 to 0.0025 mass %, Bi: 0 to 0.50 mass %, and Zr: 0 to 0.10 mass %.

The method for producing a grain-oriented electrical steel sheet according to aspects of the present invention is characterized in that the steel slab contains, in addition to the ingredient composition, at least one selected from the group consisting of Co: 0 to 0.0500 mass % and Pb: 0 to 0.0100 mass %.

The method for producing a grain-oriented electrical steel sheet according to aspects of the present invention is characterized in that the steel slab contains, in addition to the ingredient composition, at least one selected from the group consisting of: As: 0 to 0.0200 mass %; Zn: 0 to 0.0200 mass %; W: 0 to 0.0100 mass %; Ge: 0 to 0.0050 mass %; and Ga: 0 to 0.0050 mass %.

According to aspects of the present invention, it is possible to produce a grain-oriented electrical steel sheet with high magnetic flux density and low iron loss in a high yield at a low cost.

BRIEF DESCRIPTION OF THE DRAWINGS

The FIGURE is a graph showing the influence on the dimension of an edge crack in a hot-rolled sheet edge part, imposed by the S content in a steel material and slab lateral face temperature at the time of starting hot rough rolling.

DETAILED DESCRIPTION OF EMBODIMENTS OF THE INVENTION

Experiments that helped the development of the present invention will be described.

Experiment 1

As shown in Table 1, four slabs of a thickness 260 mm were prepared for each of the steels produced with an ingredient composition containing the following ingredients: C: 0.05 to 0.07 mass %, Si: 3.4 to 3.5 mass %, Mn: 0.07 to 0.08 mass %, sol. Al: 0.020 to 0.022 mass %, N: 0.007 to 0.008 mass %, and Se: 0 to 0.027 mass %, and also containing S: 0.0005 to 0.036 mass % at six different levels. The remaining part of each composition was Fe and inevitable impurities. After being heated using an electric-heating type heating furnace until the slab surface temperature reached 1420° C., the slab was extracted and air-cooled until the slab lateral face temperature reached temperature T indicated in Table 1 before hot rough rolling was started. The rough rolling was carried out in four passes to thus obtain sheet bars with a thickness of 40 mm. The rough rolling was performed such that the lateral faces of the material to be rolled were subjected to width reduction with rolling reducing amounts of 30 mm, 10 mm, 5 mm, and 2 mm after each pass. After that, hot finishing rolling was started when the surface temperature of the rolled sheets reached 1100° C. Hot-rolled sheets with a sheet thickness of 2.2 mm were obtained after six passes of rolling, then cooled with water, and each wound into a coil at 600° C.

The maximum depth of the edge cracks formed on the edge portion of the hot-rolled sheet edge part was measured from images successively photographed in-line on the exit side of the hot-finishing rolling mill. Table 1 shows the measurement results. Moreover, the FIGURE shows the influence of the S content in the steel material and the slab lateral face temperature T at the time of starting the rough rolling upon the dimension of the edge crack. We learned from the results that the depth of the edge crack caused on the edge portion of the hot-rolled sheet can be reduced to less than 10 mm by starting the rough rolling at the slab lateral face temperature T that is equal to or lower than the temperature $T_e$ defined in Expression (1) presented below:

$$T_e = -120000\,[\%\ S]^2 + 1400 \tag{1}$$

where [% S] denotes the S content (mass %) in the slab.

TABLE 1

| No. | Ingredient composition (mass %) of slab C | Si | Mn | sol. Al | N | S | Se | Slab lateral face temperature T(° C.) at the start of rough rolling | $T_e$(° C.) | Maximum depth (mm) of edge cracks in hot-rolled sheet | Magnetic flux density $B_8$ (T) of product sheet | Remarks |
|---|---|---|---|---|---|---|---|---|---|---|---|---|
| A-1 | 0.06 | 3.4 | 0.07 | 0.022 | 0.008 | 0.0005 | 0 | 1406 | 1400 | 11 | 1.84 | Comparative Example |
| A-2 | | | | | | | | 1343 | 1400 | 7 | 1.82 | Comparative Example |
| A-3 | | | | | | | | 1286 | 1400 | 7 | 1.84 | Comparative Example |
| A-4 | | | | | | | | 1226 | 1400 | 7 | 1.86 | Comparative Example |
| B-1 | 0.06 | 3.5 | 0.08 | 0.020 | 0.007 | 0.0017 | 0.015 | 1404 | 1400 | 13 | 1.92 | Comparative Example |
| B-2 | | | | | | | | 1346 | 1400 | 9 | 1.92 | Invention Example |
| B-3 | | | | | | | | 1289 | 1400 | 8 | 1.91 | Invention Example |
| B-4 | | | | | | | | 1229 | 1400 | 8 | 1.92 | Invention Example |
| C-1 | 0.05 | 3.4 | 0.08 | 0.020 | 0.008 | 0.008 | 0.014 | 1403 | 1392 | 16 | 1.92 | Comparative Example |
| C-2 | | | | | | | | 1342 | 1392 | 9 | 1.92 | Invention Example |
| C-3 | | | | | | | | 1288 | 1392 | 8 | 1.91 | Invention Example |
| C-4 | | | | | | | | 1215 | 1392 | 8 | 1.91 | Invention Example |
| D-1 | 0.07 | 3.5 | 0.08 | 0.021 | 0.008 | 0.018 | 0.015 | 1405 | 1361 | 21 | 1.91 | Comparative Example |
| D-2 | | | | | | | | 1338 | 1361 | 9 | 1.92 | Invention Example |
| D-3 | | | | | | | | 1288 | 1361 | 8 | 1.90 | Invention Example |
| D-4 | | | | | | | | 1227 | 1361 | 8 | 1.92 | Invention Example |
| E-1 | 0.06 | 3.5 | 0.07 | 0.020 | 0.008 | 0.027 | 0.012 | 1402 | 1313 | 28 | 1.92 | Comparative Example |
| E-2 | | | | | | | | 1344 | 1313 | 23 | 1.91 | Comparative Example |
| E-3 | | | | | | | | 1285 | 1313 | 9 | 1.92 | Invention Example |
| E-4 | | | | | | | | 1216 | 1313 | 9 | 1.92 | Invention Example |
| F-1 | 0.06 | 3.5 | 0.08 | 0.021 | 0.007 | 0.035 | 0 | 1400 | 1253 | 36 | 1.91 | Comparative Example |
| F-2 | | | | | | | | 1338 | 1253 | 24 | 1.90 | Comparative Example |
| F-3 | | | | | | | | 1280 | 1253 | 17 | 1.92 | Comparative Example |
| F-4 | | | | | | | | 1230 | 1253 | 9 | 1.91 | Invention Example |

The present inventors believe the reason the edge crack in the hot-rolled sheet can be mitigated by controlling the slab lateral face temperature at the start of the rough rolling in accordance with the S content in the steel material, i.e., by lowering the slab lateral face temperature at the start of the rough rolling for material with a higher S content as follows.

When the slab is heated to a high temperature, even if the whole slab is not melted, S may form a low melting-point phase in a part where S is enriched to locally form a liquid phase. When the rough rolling is carried out while the liquid phase is locally formed, a significant difference in deformation capability occurs at the boundary surface between the solid phase and liquid phase, causing large edge cracks. To prevent the edge cracks, therefore, it is necessary to control the slab lateral face temperature at the start of the rough rolling to be lower than the temperature at which the liquid phase appears. Further, the temperature at which the liquid phase appears decreases as the S content in the steel material increases, and therefore it is necessary to further lower the slab lateral face temperature at the start of the rough rolling for steel material with a high S content.

Next, grain-oriented electrical steel sheets were produced by using the various hot-rolled sheets obtained as described above to thus evaluate magnetic properties as product sheets. Specifically, the hot-rolled sheets were each subjected to hot-band annealing by holding it at 1100° C. for 60 s and then water-cooling it with water from 800 to 350° C. at a rate of 50° C./s, followed by pickling to remove scale from the surface of the steel sheet. The sheet was then subjected to one cold rolling to form a cold-rolled sheet with a final sheet thickness of 0.27 mm, and then the cold-rolled sheet was subjected to primary recrystallization annealing which also served as decarburization annealing at 820° C. for 120 s under a wet atmosphere containing $H_2$ and $N_2$ and having a dew point of 55° C. An annealing separator mainly composed of MgO was applied to the steel sheet surface with a coating weight of 5 g/m$^2$ per surface and dried. Then, finishing annealing was performed by causing secondary recrystallization and carrying out purification including holding the temperature of 1200° C. for 20 hours. An atmosphere mainly composed of $H_2$ was used in the temperature range of 850° C. or higher of the finishing annealing. After removing the unreacted annealing separator from the surface of the steel sheet resulting from the finishing annealing, a phosphate-based insulation tension coating was applied to the surface, and flattening annealing which also served as the baking of the coating and steel sheet shape correction was carried out to form a product sheet.

Test specimens for the measurement of magnetic properties were taken from both the innermost and the outermost winding parts of a coil of the thus-obtained product sheet, and the magnetic flux density $B_8$ at a magnetic force of 800 A/m was measured according to the method defined by JIS C 2550-1 (2011). The lowest value of the magnetic flux density of each coil was determined as a coil-specific guaranteed value. The results thereof are listed in Table 1 as well. From these results, it is observed that, in order to achieve an excellent magnetic flux density of $B_8 \geq 1.90$ T, the steel material needs to contain 0.0010 mass % or more S.

Experiment 2

Ten steel slabs with a thickness of 220 mm having an ingredient composition containing C: 0.06 mass %, Si: 3.1 mass %, Mn: 0.09 mass %, S: 0.009 mass %, Se: 0.015 mass %, sol. Al: 0.020 mass %, and N: 0.007 mass % with the remaining part containing Fe and inevitable impurities were prepared. The slabs were each subjected to slab heating 1 in which the slab was heated in a combustion-gas type heating furnace until the slab surface temperature reached "holding temperature 1" shown in Table 2 and held at the temperature for 20 min. The slab was then extracted from the combustion-gas type furnace and air-cooled until the slab surface temperature exhibited the temperature decrease amount indicated in Table 2. Subsequently, the slab was subjected to slab heating 2 in which the slab was charged in an induction-heating type heating furnace and heated until the slab surface temperature reached "holding temperature 2" indicated in Table 2 at a heating rate of 100° C./hr, and held at the temperature for 30 min. The slab was extracted from the induction heating furnace and air-cooled until the slab lateral face temperature reached the range of 1350° C. to 1280° C. before rough rolling was started. The rough rolling was carried out in 3 passes to form sheet bars having a sheet thickness of 30 mm. In the rough rolling, the lateral faces of the rolled sheet were subjected to width reduction by rolling reduction of 10 mm, 6 mm, and 2 mm after each pass. After that, finishing rolling of the rolled sheet (sheet bar) was started at the surface temperature of 1200° C. to form a hot-rolled sheet with a sheet thickness of 2.8 mm after six passes of rolling. The hot-rolled sheet was then cooled with water and wound into a coil at 500° C. The maximum depth of the edge cracks caused on the edge portion of the hot-rolled sheet edge part was measured from images successively photographed in-line on the exit side of the hot-finishing rolling mill. Table 2 shows the measurement results.

TABLE 2

| | Slab heating condition | | | | | | | | |
|---|---|---|---|---|---|---|---|---|---|
| No. | Holding temperature1(° C.) in Heating 1 | Temperature Decrease amount (° C.) between Heating 1 and Heating 2 | Heating rate (° C./hr) in Heating 2 | Holding temperature 2(° C.) in Heating 2 | Slab lateral face temperature T(° C.) at the start of rough rolling | $T_e$(° C.) | Maximum depth (mm) of edge cracks in hot-rolled sheet | Magnetic flux density $B_8$ (T) of product sheet | Remarks |
| G-1 | — | — | 100 | 1380 | 1316 | 1390 | 9 | 1.91 | Invention Example |
| G-2 | 1100 | 50 | 100 | 1380 | 1328 | 1390 | 4 | 1.92 | Invention Example |
| G-3 | 1100 | 200 | 100 | 1380 | 1334 | 1390 | 4 | 1.91 | Invention Example |
| G-4 | 1100 | 300 | 100 | 1380 | 1288 | 1390 | 9 | 1.92 | Invention Example |
| G-5 | 1200 | 50 | 100 | 1380 | 1305 | 1390 | 4 | 1.92 | Invention Example |
| G-6 | 1200 | 200 | 100 | 1380 | 1320 | 1390 | 3 | 1.91 | Invention Example |
| G-7 | 1200 | 300 | 100 | 1380 | 1301 | 1390 | 8 | 1.91 | Invention Example |
| G-8 | 1300 | 50 | 100 | 1380 | 1268 | 1390 | 3 | 1.92 | Invention Example |
| G-9 | 1300 | 200 | 100 | 1380 | 1349 | 1390 | 2 | 1.92 | Invention Example |
| G-10 | 1300 | 300 | 100 | 1380 | 1304 | 1390 | 9 | 1.92 | Invention Example |

The value $T_e$ calculated from the steel ingredients of the abovementioned slab is 1390° C. This satisfies the condition $T \leq T_e$, in relation to the slab lateral face temperature T at the start of the rough rolling in all the cases, and the maximum edge crack depth is 10 mm or less in all the hot-rolled sheets. However, the largest edge crack depth is 5 mm or less in some hot-rolled sheets, which shows the remarkable effect of preventing an edge crack. Those hot-rolled sheets were obtained by heating the slab until the slab surface temperature reached the range of 1100 to 1300° C. and holding the temperature, lowering the temperature once within the decreased amount of the slab surface temperature in the range of 50 to 200° C., then heating the slab again until the slab surface temperature reached 1380° C., and holding the temperature before the rough rolling was started.

Although the reason for the above has not yet sufficiently been clarified, the present inventors consider as follows: in the combustion-gas type slab heating, the slab surface was easily heated while the slab center was difficult to be heated, which might cause a large temperature difference within the slab. When the slab with such a large temperature difference therein was heated to 1300° C. or higher, which exceeded the temperature at which the liquid phase locally appeared at the start of the rough rolling, a few edge cracks were expected to occur. In contrast, when a slab was heated until the slab surface temperature reached the range of 1100 to 1300° C. and held at the temperature, subsequently cooled once with the decreased amount in the slab surface temperature in the range of 50° C. to 200° C., heated until the slab surface temperature reached 1380° C., and held at the temperature, a large temperature difference was caused in the slab at the first slab heating, while, as the temperature distribution in the slab was uniformized at the cooling step and the temperature uniformizing effect within the slab was held after the second slab heating, the slab lateral face temperature at the start of the rough rolling was lower than the temperature at which the liquid phase appeared. As a result, it is considered that the edge cracks were remarkably prevented.

Next, grain-oriented electrical steel sheets were produced by using the hot-rolled sheets obtained as described above to thus evaluate the magnetic properties of the product sheets. Specifically, the hot-rolled sheet was pickled to remove scale from the steel sheet surface and subjected to cold rolling for the first time to achieve an intermediate sheet thickness of 1.5 mm. The sheet was then subjected to intermediate annealing including holding the sheet at 1050° C. for 30 seconds and cooling the sheet with water from 800° C. to 350° C. at a rate of 80° C./s, followed by pickling, and then subjected to cold rolling for the second time to obtain a cold-rolled sheet with a final sheet thickness of 0.23 mm. The cold-rolled sheet was then subjected to primary recrystallization annealing which also served as decarburization annealing at 840° C. for 100 seconds under a wet atmosphere containing $H_2$ and $N_2$ and having a dew point of 60° C. After an annealing separator mainly composed of MgO was applied to the steel sheet surface with a coating weight of 8 g/m$^2$ per surface and dried, the cold-rolled sheet was subjected to finishing annealing including causing secondary recrystallization and performing purification that held the sheet at 1180° C. for 5 hours. An atmosphere mainly composed of $H_2$ was used in the temperature range of 1100° C. or higher in the annealing. After the unreacted annealing separator was removed from the surface of the steel sheet resulting from the finishing annealing, a phosphate-based insulation tension coating was applied thereto, and flattening annealing which also served as the baking of the coating and steel sheet shape correction was carried out to thus obtain a product sheet.

Test specimens for measuring magnetic properties were taken out from both the innermost and the outermost winding parts of a coil of the thus-obtained product sheet to the measure the magnetic flux density $B_8$ at a magnetic force of 800 A/m according to the method defined by JIS C 2550-1 (2011). The lowest magnetic flux density value of each coil was determined as a coil-specific guaranteed value, the results of which are also shown in Table 2. As seen from the results, all of the steel sheets produced under the conditions compliant with aspects of the present invention exhibit an excellent magnetic flux density of $B_8 \geq 1.90$ T.

Next, the ingredient composition required for the steel material (a slab) used for producing a grain-oriented electrical steel sheet according to aspects of the present invention will be described.

C: 0.02 to 0.10 Mass %

C is an ingredient necessary for improving the hot-rolled sheet texture by using an austenite-ferrite transformation that occurs at the time of the hot rolling and the soaking in the hot-band annealing. The C content of less than 0.02 mass % causes a grain boundary strengthening effect of C to be lost and causes a defect, such as a slab crack, that hinders production. Whereas, the C content exceeding 0.10 mass % not only increases the load in the decarburization annealing step but also causes incomplete decarburization, which may cause magnetic aging in the product sheet and might lead to deterioration of the magnetic properties. For these reasons, the C content should fall within the range of 0.02 to 0.10 mass %, preferably within the range of 0.03 to 0.08 mass %.

Si: 2.5 to 5.5 Mass %

Si is an ingredient extremely effective for enhancing the specific resistance of steel and decreasing eddy-current loss that constitutes a part of iron loss. When Si content is less than 2.5 mass %, however, the decreasing effect is too small to achieve excellent iron loss properties. Although the specific resistance of steel monotonously increases until the Si content reaches 11 mass %, when Si content exceeds 5.5 mass %, workability becomes significantly low, and the production including the rolling becomes difficult. For these reasons, the Si content should fall within the range of 2.5 to 5.5 mass %, preferably within the range of 3.0 to 4.0 mass %.

Mn: 0.01 to 0.30 Mass %

Mn is an important ingredient in the production of grain-oriented electrical steel sheets because Mn forms MnS and MnSe, and functions as an inhibitor that inhibits the growth of normal grains during the temperature increasing process in the finishing annealing. When the Mn content is less than 0.01 mass %, however, the absolute amount of the inhibitor becomes insufficient, and the power to inhibit the growth of the normal grains becomes insufficient. On the contrary, when the Mn content exceeds 0.30 mass %, it is difficult to achieve sufficient dissolution at the time of the slab heating, which may deteriorate the magnetic properties. For these reasons, the Mn content should be kept in the range of 0.01 to 0.30 mass %, and preferably in the range of 0.05 to 0.20 mass %.

S: 0.0010 to 0.040 Mass %

S forms MnS serving as an inhibitor by coupling with Mn. When the S content is less than 0.0010 mass %, however, a sufficient amount of inhibitor cannot be obtained, and the effect of enhancing the magnetic properties is not sufficiently achieved. On the contrary, when the content amount exceeds 0.040 mass %, the ingredient cannot be dissolved sufficiently by slab heating, which greatly deteriorates the magnetic properties. Also, when the content amount exceeds 0.040 mass %, edge cracks occur at the time of the hot rolling. Accordingly, in order to satisfy both the magnetic properties and producibility, the S content should be kept in the range of 0.0010 to 0.040 mass %, preferably in the range of 0.0020 to 0.015 mass %.

Se: 0 to 0.040 Mass %

Similarly to S, Se forms MnSe serving as an inhibitor by coupling with Mn. However, when the content amount exceeds 0.040 mass %, sufficient dissolution cannot be achieved by slab heating, which greatly deteriorates the magnetic properties. For these reasons, the content amount of Se should be kept in the range of 0 to 0.040 mass %, preferably in the range of 0.005 to 0.020 mass %.

Sol. Al: 0.010 to 0.040 Mass %

Al forms AlN and is precipitated, functioning as an inhibitor which inhibits the growth of the normal grains in the secondary recrystallization annealing. Thus, Al is an important ingredient in grain-oriented electrical steel sheets. When the content amount of Al in the form of acid-soluble Al (sol. Al) is less than 0.010 mass %, however, the absolute amount of the inhibitor becomes insufficient, and the power to inhibit the growth of the normal grains becomes insufficient. On the contrary, when the content amount of sol. Al exceeds 0.040 mass %, sufficient dissolution into the steel cannot be achieved at the time of the slab heating, and fine distribution into the steel cannot be achieved, significantly deteriorating the magnetic properties. For these reasons, the content amount of Al in the form of sol. Al should be kept in the range of 0.010 to 0.040 mass %, preferably in the range of 0.015 to 0.030 mass %.

N: 0.004 to 0.020 Mass %

N forms AlN that serves as an inhibitor by being coupled with Al and being precipitated. When the content amount is less than 0.004 mass %, however, the absolute amount of the inhibitor is insufficient, and the power to inhibit the growth of the normal grains is insufficient. Whereas, when the content amount exceeds 0.020 mass %, the slab might be blistered in the hot rolling. For these reasons, the content amount of N should be kept in the range of 0.004 to 0.020 mass %, preferably in the range of 0.006 to 0.010 mass %.

In addition to the requisite ingredients described above, to enhance the magnetic properties, the steel material used in accordance with aspects of the present invention may contain at least one selected from the group consisting of: Ni: 0 to 1.00 mass %, Sb: 0 to 0.50 mass %, Sn: 0 to 0.50 mass %, Cu: 0 to 0.50 mass %, Cr: 0 to 0.50 mass %, P: 0 to 0.50 mass %, Mo: 0 to 0.50 mass %, Nb: 0 to 0.020 mass %, V: 0 to 0.010 mass %, B: 0 to 0.0025 mass %, Bi: 0 to 0.50 mass %; and Zr: 0 to 0.10 mass %. If any of the ingredients exceeds the abovementioned upper limit value, the development of secondary recrystallization grains is inhibited, deteriorating the magnetic properties instead. From the viewpoint of surely enhancing the magnetic properties, it is desirable to add the ingredients in the following amounts: Ni: 0.01 mass % or more, Sb: 0.005 mass % or more, Sn: 0.005 mass % or more, Cu: 0.01 mass % or more, Cr: 0.01 mass % or more, P: 0.005 mass % or more, Mo: 0.005 mass % or more, Nb: 0.001 mass % or more, V: 0.001 mass % or more, B: 0.0002 mass % or more, Bi: 0.005 mass % or more, and Zr: 0.001 mass % or more.

To enhance the magnetic properties, the steel material used in accordance with aspects of the present invention may contain, in addition to the ingredient composition described above, at least one selected from the group consisting of Co: 0 to 0.0500 mass % and Pb: 0 to 0.0100 mass %. If any of the ingredients exceeds the abovementioned upper limit value, the development of secondary recrystallization grains is inhibited, deteriorating the magnetic properties instead. Further, from the viewpoint of surely enhancing the magnetic properties, it is desirable to add the ingredients in the following amounts: Co: 0.0020 mass % or more and Pb: 0.0001 mass % or more.

In addition to the ingredient composition described above, for the purpose of enhancing the magnetic properties, the steel material used in accordance with aspects of the present invention may contain at least one selected from the group consisting of As: 0 to 0.0200 mass %, Zn: 0 to 0.0200 mass %, W: 0 to 0.0100 mass %, Ge: 0 to 0.0050 mass %, and Ga: 0 to 0.0050 mass %. If any of the ingredients exceeds the abovementioned upper limit value, the development of secondary recrystallization grains is inhibited, deteriorating the magnetic properties instead. Further, from the viewpoint of surely enhancing the magnetic properties, it is desirable to add the ingredients in the following amounts: As: 0.0010 mass % or more, Zn: 0.0010 mass % or more, W: 0.0010 mass % or more, Ge: 0.0001 mass % or more, and Ga: 0.0001 mass % or more.

Ti is a harmful ingredient that forms a nitride and spoils the inhibitor effect of AlN and is thus preferably reduced as little as possible. Although reducing Ti increases the refining costs, 0.010 mass % or less Ti can be acceptable. A more preferable content amount is 0.0020 mass % or less.

In the steel slab used in accordance with aspects of the present invention, the remaining part other than the abovementioned ingredients is Fe and inevitable impurities. In this context, the term "inevitable impurities" denotes components that inevitably enter from raw materials, scrap, a ladle for steel production, and so on, at the time of the production of steel.

Next, a method for producing a grain-oriented electrical steel sheet according to aspects of the present invention will be described.

The steel material (the slab) used for producing a grain-oriented electrical steel sheet according to aspects of the present invention may be produced by melting steel with the abovementioned ingredient composition through an ordinary publicly-known refining process and further implementing a commonly known method such as an ingot-making method or a continuous casting method. Alternatively, it is also acceptable to produce a thin cast piece with a thickness of 100 mm or less by a direct casting method.

The slab or the thin cast piece described above is heated by an ordinary method and then subjected to hot rolling. It is desirable that the slab heating temperature before the hot rolling is 1300° C. or higher so that the inhibitor-forming ingredients are completely dissolved in the steel. The slab heating may be carried out in one heating furnace to 1300° C. or higher or can use two or more heating furnaces. The method for heating the slab may adopt commonly known methods such as combustion gas heating, electric heating, or induction heating.

One of the primary characteristics according to aspects of the present invention is that the slab heating step comprises the following steps: heating the slab until the slab surface temperature reaches a temperature in the range of 1100 to 1300° C. and holding the slab at that temperature: cooling the slab with the decrease amount in the slab surface temperature in the range of 50 to 200° C.; heating the slab again until the slab surface temperature reaches 1300° C. or higher at a heating rate of 100° C./hr or higher: and holding the slab at the temperature for 0 min to 180 min. The reason for setting the heating rate for the re-heating process to 100° C./hr or higher is to avoid shape defects in a skid part supporting the slab that may be caused by a volume change due to having a two-phase structure of ferrite-austenite in the temperature range of 1300° C. and lower. Further, the method for lowering the temperature of the slab may use commonly known methods such as air cooling, gas cooling, water cooling, or contact cooling that uses a roller or the like.

The slab heated until the surface temperature reaches 1300° C. or higher as described above is subsequently cooled and subjected to rough rolling of one or more passes in a temperature range where the surface temperature of the rolled sheet is from 1100° C. to $T_e$, both inclusively, forming a sheet bar. It is possible to prevent edge cracks by carrying out width reduction after at least one pass of rough rolling. The width reduction can be performed by commonly known methods such as using a vertical roller with the reduction amount preferably in the range of 1 to 50 mm, more preferably in the range of 5 to 30 mm. In accordance with aspects of the present invention, the rolling reduction amount denotes a value for each side.

Another primary characteristic according to aspects of the present invention is that the hot rough rolling is started when the lateral face temperature T of the slab serving as the material to be rolled is equal to or lower than the temperature $T_e$ defined by Expression (1) presented below:

$$T_e = -120000\,[\%\ S]^2 + 1400 \tag{1}$$

where [% S] denotes the S content (mass %) in the slab. Moreover, the slab lateral face temperature T is the highest temperature measured when the whole length of the slab lateral face is measured.

The finishing rolling following the rough rolling is preferably conducted in two or more passes while the surface temperature of the rolled sheet is in the range of 800 to 1300° C. to improve the texture of the hot-rolled sheet. From the viewpoint of controlling the carbide texture and preventing defects including cracks, the coil winding temperature performed after the finishing rolling is preferably in the range of 400 to 750° C., and more preferably, in the range of 500 to 700° C.

For a more uniform steel sheet texture and less variation in the magnetic properties, it is preferable to carry out hot-band annealing by holding the steel sheet (hot-rolled sheet) after the hot rolling at a temperature in the range of 800 to 1250° C. for 5 seconds or longer, more preferably in the range of 900 to 1150° C. for 10 to 180 seconds. From the viewpoint of controlling the configurations of the second phase and precipitates, it is preferable to cool the hot-rolled sheet after the heat treatment in the temperature range from 800 to 350° C. at a cooling rate of 5 to 100° C./s, more preferably, at a cooling rate of 15 to 80° C./s.

Next, it is desirable to perform descaling on the steel sheet (hot-rolled sheet) resulting from the hot rolling or hot-band annealing to remove an oxide film formed during the hot rolling from the steel sheet surface. The descaling method can use commonly known methods such as pickling using heated acid, mechanical descaling that mechanically removes the scale, or a method combining these two.

The hot-rolled sheet from which the scale was removed is cold rolled once, or two or more times with an intermediate annealing between each rolling to form a cold-rolled sheet with a final sheet thickness. The intermediate annealing, when performed, is preferable to use the condition where the sheet is held at a temperature in the range of 800 to 1250° C. for 5 seconds or longer. When the temperature is lower than 800° C., the recrystallization grains may become too small, decreasing the Goss-nuclei in the primary recrystallization texture and deteriorating the magnetic properties. Whereas, when the temperature exceeds 1250° C., the inhibitor may grow or decompose rapidly, also deteriorating the magnetic properties. A more preferable condition is to hold at a temperature in the range of 900 to 1150° C. for 10 to 180 seconds.

From the viewpoint of controlling the configurations of the second phase and precipitates, the cooling after the heat treatment is preferably conducted from 800 to 350° C. at a rate of 5 to 100° C./s, and more preferably at a cooling rate of 15 to 80° C./s. When intermediate annealing is carried out, it is preferable to remove the rolling oil beforehand. It is also preferable to remove the scale that was formed during the annealing from the steel sheet surface after the intermediate annealing. The descaling method may use commonly known methods such as pickling using heated acid, mechanical descaling that mechanically removes the scale, or a method combining these two.

A lubricant such as rolling oil is preferably used in the cold rolling to decrease the rolling load and to improve the steel sheet shape after the rolling. From the viewpoint of controlling the texture, when the cold rolling is performed once to achieve the final sheet thickness, the total rolling reduction in the cold rolling is preferably in the range of 50 to 92%. Whereas, when the cold rolling is performed two or more times, the total rolling reduction of the final cold rolling to reach a final sheet thickness is preferably in the range of 50 to 92%.

The steel sheet (cold-rolled sheet) that was cold-rolled to the final sheet thickness is then subjected to primary recrystallization annealing which also serves as decarburization annealing. Before the treatment, it is desirable to clean the steel sheet surface by degreasing or pickling. A preferable condition for the decarburization annealing in the primary recrystallization annealing is to maintain the temperature in the range of 750 to 950° C. for 10 seconds or longer. A more preferable condition is to maintain the temperature in the range of 800 to 900° C. for 30 to 180 seconds. The atmosphere for the decarburization annealing preferably uses a wet atmosphere including $H_2$ and $N_2$ and having a dew point in the range of 20 to 80° C., more preferably in the range of 40 to 70° C. As a result of the decarburization annealing, the C content in the steel is decreased to 0.0050 mass % or less, which is unlikely to cause magnetic aging.

An annealing separator mainly composed of MgO is preferably applied to the surface of the steel sheet resulting from the primary recrystallization annealing with a coating weight of 3 g/m$^2$ or more per side. The upper limit of the coating weight is not particularly limited but is preferably approximately 10 g/m$^2$ from the viewpoint of production costs. MgO may be applied to the steel sheet surface in a slurry form or may be applied in a dry form through electrostatic application. When using the slurry form, the temperature of the slurry solution is preferably maintained at 15° C. or lower to prevent the viscosity of the slurry from increasing. Also, the slurry solution is preferably preserved separately in a mixing tank and a solution tank used for the application to maintain the slurry concentration at a constant level. Note that "an annealing separator mainly composed of MgO" means that the MgO content is 60 mass % or more in the annealing separator as a whole.

The steel sheet coated with the annealing separator is subsequently wound into a coil, and subjected to finishing annealing in an upended state to develop secondary recrystallization grains and form a forsterite coating on the steel sheet surface. It is preferable to wind a band or the like around the outer circumference of the coil to prevent the outer winding from being unwound.

The finishing annealing is preferably conducted by heating the sheet to 800° C. or higher to complete the secondary recrystallization. When forming the forsterite coating on the steel sheet surface, it is preferable to heat the sheet to 1050° C. or higher. To eliminate the inhibitor-forming ingredients and impurities from the steel and to achieve excellent magnetic properties, it is preferable to conduct purification by holding the sheet at a temperature in the range of 1050 to 1300° C. for 3 hours or longer. The purification can reduce the inhibitor-forming ingredients to a level of impurities. For a part of the temperature range of 800° C. or higher at least including the purification where the sheet is held at a temperature of 1050 to 1300° C. for 3 hours or longer, it is preferable to use an $H_2$-containing atmosphere.

After finishing annealing, it is preferable to remove the unreacted annealing separator from the surface of the steel sheet by washing with water, brushing, or pickling, and then conduct flattening annealing to correct a winding curl and shape defects of the steel sheet that occurred during the finishing annealing and to also decrease iron loss.

Grain-oriented electrical steel sheets are often used in a laminated state, and in this case, an insulation coating is preferably formed on the steel sheet surface to secure the insulation properties. The insulation coating can preferably use a tension-applying type, which has the effect of decreasing the iron loss, and may be formed on the steel sheet surface by applying coating liquid before the flattening annealing and baking it during the flattening annealing or may be formed in another line. To enhance coating adhesion and achieve a higher iron loss decreasing effect, other methods may be applied. These methods include forming a tension-applying coating via a binder or vapor-depositing an inorganic matter on a steel sheet surface layer using a physical vapor deposition scheme or a chemical vapor deposition scheme.

To further decrease the iron loss, a magnetic domain segmentation treatment may be performed in any one of the steps after the cold rolling by forming grooves with an etching process on the steel sheet surface, by forming a thermal strain region by emitting thermal energy beams of laser, plasma, or the like on the steel sheet surface after the formation of the insulation coating, or by forming a processing strain region by pressing a roller having protrusions or the like against the steel sheet surface.

Example 1

As shown in Table 3, four slabs of a thickness of 260 mm were prepared for each of the steels produced with ingredient composition containing the following ingredients: C: 0.06 to 0.08 mass %, Si: 3.3 to 3.5 mass %, Mn: 0.08 to 0.10 mass %, Se: 0.016 to 0.020 mass %, sol. Al: 0.018 to 0.025 mass %, and N: 0.007 to 0.009 mass % and also containing S: 0.0008 to 0.022 mass % at four different levels. The remaining part of each composition was Fe and inevitable impurities. Each slab was subjected to slab heating 1 in which the slab was heated in a combustion-gas type heating furnace until the slab surface temperature reached "holding temperature 1" shown in Table 3 and was held at the temperature for 60 min. Subsequently, the slab was extracted from the combustion-gas type heating furnace and cooled by air until the slab surface temperature satisfied the temperature decrease amount shown in Table 3. The slab was then subjected to slab heating 2 in which the slab was heated in an induction-heating type heating furnace until the slab surface temperature reached "holding temperature 2" shown in Table 3 at a heating rate of 200° C./hr and held at the temperature for 10 min. The slab was then extracted and cooled by air until the slab lateral face temperature reached 1258 to 1294° C. before hot rough rolling was started. The rough rolling was carried out in 5 passes to form a sheet bar with a sheet thickness of 50 mm. Each lateral face of the rolled sheet was subjected to width reduction by reduction amounts of 20 mm and 5 mm after 3 passes and 5 passes during the rough rolling, respectively. After that, hot finishing rolling was started when the surface temperature of the rolled sheet reached 1200° C. to form a hot-rolled sheet with a sheet thickness of 2.6 mm after six passes. The hot-rolled sheet was then cooled with water and wound into a coil at the temperature of 500° C. In this treatment, the maximum depth of the edge cracks caused in the hot-rolled sheet edge part was measured from images successively photographed in-line on the exit side of the hot-finishing rolling mill. The results are shown in Table 3.

TABLE 3

| | Slab ingredient composition(mass %) | | | | | | | Slab heating condition | | |
|---|---|---|---|---|---|---|---|---|---|---|
| No. | C | Si | Mn | sol. Al | N | S | Se | Holding temperature 1 (° C.) in Heating 1 | Temperature Decrease amount (° C.) between Heating 1 and Heating 2 | Heating rate (° C./hr) in Heating 2 |
| H-1 | 0.07 | 3.3 | 0.10 | 0.018 | 0.008 | 0.0008 | 0.018 | — | — | 200 |
| H-2 | | | | | | | | 1200 | 50 | 200 |
| H-3 | | | | | | | | 1200 | 200 | 200 |
| H-4 | | | | | | | | 1200 | 300 | 200 |
| I-1 | 0.07 | 3.5 | 0.08 | 0.025 | 0.009 | 0.0017 | 0.017 | — | — | 200 |
| I-2 | | | | | | | | 1200 | 50 | 200 |
| I-3 | | | | | | | | 1200 | 200 | 200 |
| I-4 | | | | | | | | 1200 | 300 | 200 |
| J-1 | 0.08 | 3.4 | 0.09 | 0.022 | 0.007 | 0.009 | 0.020 | — | — | 200 |
| J-2 | | | | | | | | 1200 | 50 | 200 |
| J-3 | | | | | | | | 1200 | 200 | 200 |
| J-4 | | | | | | | | 1200 | 300 | 200 |

TABLE 3-continued

| | | | | | | | | | | |
|---|---|---|---|---|---|---|---|---|---|---|
| K-1 | 0.06 | 3.3 | 0.09 | 0.021 | 0.007 | 0.022 | 0.016 | — | — | 200 |
| K-2 | | | | | | | | 1200 | 50 | 200 |
| K-3 | | | | | | | | 1200 | 200 | 200 |
| K-4 | | | | | | | | 1200 | 300 | 200 |

| No. | Slab heating condition Holding temperature 2 (° C.) in Heating 2 | Slab lateral face temperature T(° C.) at the start of rough rolling | $T_e$(° C.) | Maximum depth (mm) of edge cracks in hot-rolled sheet | Magnetic flux density $B_8$ (T) of product sheet | Remarks |
|---|---|---|---|---|---|---|
| H-1 | 1420 | 1267 | 1400 | 8 | 1.83 | Comparative Example |
| H-2 | 1420 | 1277 | 1400 | 7 | 1.84 | Comparative Example |
| H-3 | 1420 | 1260 | 1400 | 7 | 1.84 | Comparative Example |
| H-4 | 1420 | 1248 | 1400 | 7 | 1.86 | Comparative Example |
| I-1 | 1420 | 1266 | 1400 | 8 | 1.91 | Invention Example |
| I-2 | 1420 | 1270 | 1400 | 3 | 1.90 | Invention Example |
| I-3 | 1420 | 1261 | 1400 | 3 | 1.92 | Invention Example |
| I-4 | 1420 | 1261 | 1400 | 8 | 1.91 | Invention Example |
| J-1 | 1420 | 1270 | 1390 | 8 | 1.91 | Invention Example |
| J-2 | 1420 | 1243 | 1390 | 3 | 1.92 | Invention Example |
| J-3 | 1420 | 1279 | 1390 | 3 | 1.91 | Invention Example |
| J-4 | 1420 | 1255 | 1390 | 8 | 1.92 | Invention Example |
| K-1 | 1420 | 1268 | 1342 | 9 | 1.91 | Invention Example |
| K-2 | 1420 | 1274 | 1342 | 3 | 1.92 | Invention Example |
| K-3 | 1420 | 1273 | 1342 | 4 | 1.92 | Invention Example |
| K-4 | 1420 | 1271 | 1342 | 9 | 1.92 | Invention Example |

With respect to the value $T_e$ calculated from the steel components of the slab, the slab lateral face temperature T at the time of starting the rough rolling satisfied the condition $T \leq T_e$ in all the examples. Thus, the maximum depth of the edge cracks that occurred in the edge part of the hot-rolled coil was all as small as 10 mm or less. Moreover, it was observed that the maximum depth of the edge cracks was 5 mm or less so that the edge crack was further decreased in the hot-rolled sheet obtained in the following manner: the slab was heated until the slab surface temperature reached 1200° C., held at the temperature, cooled with a decrease in the slab surface temperature in the range of 50° C. to 200° C., heated until the slab surface temperature reached 1420° C., and held at the temperature followed by the rough rolling.

Next, to evaluate the magnetic properties of the final product sheet, the hot-rolled sheet was subjected to hot-band annealing by holding the sheet at 1000° C. for 20 seconds and cooling with water from 800 to 350° C. at a rate of 10° C./s, followed by pickling to remove scales from the surface. Next, the sheet was cold rolled for the first time to achieve an intermediate sheet thickness of 1.5 mm and subjected to intermediate annealing by holding the sheet at 1200° C. for 30 seconds and cooling with water from 800 to 350° C. at a rate of 10° C./s. The sheet was then pickled again and cold rolled for the second time to obtain a cold-rolled sheet with a final sheet thickness of 0.18 mm. Subsequently, primary recrystallization annealing which also served as decarburization annealing was performed on the cold-rolled sheet at 900° C. for 120 seconds under a wet atmosphere containing $H_2$ and $N_2$ and having a dew point of 45° C. After an annealing separator mainly composed of MgO was applied to the steel sheet surface in an amount of 7 g/m$^2$ per surface and dried, the sheet was subjected to finishing annealing including causing secondary recrystallization and then performing purification by holding the sheet at 1150° C. for 20 hours. In the finishing annealing, an atmosphere mainly composed of $H_2$ was used for the temperature range of 1000° C. or higher. After the unreacted annealing separator was removed from the surface of the steel sheet resulting from the finishing annealing, a phosphate-based insulation tension coating was coated thereon, and flattening annealing which also served as coating baking and steel sheet shape correction was carried out, obtaining a product sheet.

Test specimens for measuring magnetic properties were taken from both the innermost and outermost winding parts of a coil of the thus-obtained product sheet to measure the magnetic flux density $B_8$ at a magnetic force of 800 A/m according to the method defined by JIS C 2550-1 (2011). The lowest magnetic flux density value of each coil was determined as a coil-specific guaranteed value. Table 3 shows the measurement results as well. As seen from the results, all of the product sheets produced by using the slabs having the ingredient composition compliant with aspects of the present invention under the conditions compliant with aspects of the present invention exhibit an excellent magnetic flux density of $B_8 \geq 1.90$ T.

Example 2

A steel slab that was 220 mm thick and had an ingredient composition containing the various ingredients shown in Table 4 and the remaining part being Fe and inevitable impurities was subjected to a slab heating 1 including heating the slab in a combustion-gas type heating furnace until the slab surface temperature reached 1100° C. and holding at the temperature for 30 min. After being extracted from the combustion-gas type furnace and cooled by air until the slab surface temperature decreased by 100° C., the slab was put into an induction-type heating furnace and subjected to slab heating 2 including heating the slab until the slab surface temperature reached 1420° C. and holding at the temperature for 30 min. After being extracted from the induction-type heating furnace and cooled by air until the slab lateral face temperature reached the temperature T shown in Table 4, the slab was subjected to hot rough rolling. The rough rolling was performed in 3 passes to obtain a sheet bar with a sheet thickness of 30 mm. The lateral faces of the rolled sheet were subjected to width reduction by reduction amounts of 10 mm, 5 mm, and 2 mm after each pass. Hot finishing rolling was started when the surface temperature of the rolled sheet was 1200° C. to form a hot-rolled sheet with a sheet thickness of 2.6 mm after seven passes. The hot-rolled sheet was then cooled with water and wound into a coil at the temperature of 600° C. From images successively photographed in-line on the exit side of the hot-finishing rolling mill, the maximum depth of the edge cracks caused in the edge part of the thus-obtained hot-rolled sheet was measured. Table 4 shows the results.

TABLE 4

| | Slab ingredient composition (mass %) | | | | | | | |
|---|---|---|---|---|---|---|---|---|
| No. | C | Si | Mn | sol. Al | N | S | Se | Others |
| 1 | 0.01 | 3.3 | 0.14 | 0.020 | 0.006 | 0.009 | 0.000 | — |
| 2 | 0.02 | 3.3 | 0.12 | 0.019 | 0.007 | 0.008 | 0.000 | — |
| 3 | 0.05 | 3.2 | 0.14 | 0.023 | 0.005 | 0.010 | 0.000 | — |
| 4 | 0.10 | 3.4 | 0.12 | 0.020 | 0.006 | 0.007 | 0.000 | — |
| 5 | 0.13 | 3.3 | 0.10 | 0.021 | 0.007 | 0.006 | 0.000 | — |
| 6 | 0.06 | 2.1 | 0.14 | 0.022 | 0.007 | 0.008 | 0.000 | — |
| 7 | 0.05 | 2.6 | 0.11 | 0.020 | 0.007 | 0.008 | 0.000 | — |
| 8 | 0.05 | 3.5 | 0.12 | 0.018 | 0.006 | 0.007 | 0.000 | — |
| 9 | 0.06 | 5.3 | 0.11 | 0.018 | 0.007 | 0.008 | 0.000 | — |
| 10 | 0.07 | 5.9 | 0.12 | 0.020 | 0.008 | 0.009 | 0.000 | — |
| 11 | 0.05 | 3.4 | 0.00 | 0.018 | 0.007 | 0.006 | 0.000 | — |
| 12 | 0.06 | 3.5 | 0.01 | 0.027 | 0.006 | 0.007 | 0.000 | — |
| 13 | 0.05 | 3.4 | 0.15 | 0.020 | 0.007 | 0.008 | 0.000 | — |
| 14 | 0.06 | 3.5 | 0.26 | 0.018 | 0.006 | 0.008 | 0.000 | — |
| 15 | 0.07 | 3.3 | 0.34 | 0.021 | 0.007 | 0.006 | 0.000 | — |
| 16 | 0.05 | 3.4 | 0.10 | 0.020 | 0.007 | 0.000 | 0.000 | — |
| 17 | 0.06 | 3.5 | 0.09 | 0.026 | 0.007 | 0.001 | 0.000 | — |
| 18 | 0.06 | 3.4 | 0.08 | 0.019 | 0.007 | 0.008 | 0.000 | — |
| 19 | 0.07 | 3.3 | 0.12 | 0.021 | 0.007 | 0.035 | 0.000 | — |
| 20 | 0.05 | 3.3 | 0.13 | 0.020 | 0.007 | 0.043 | 0.000 | — |
| 21 | 0.06 | 3.4 | 0.15 | 0.020 | 0.006 | 0.006 | 0.001 | — |
| 22 | 0.05 | 3.4 | 0.10 | 0.020 | 0.008 | 0.008 | 0.021 | — |
| 23 | 0.04 | 3.5 | 0.11 | 0.018 | 0.007 | 0.008 | 0.036 | — |
| 24 | 0.06 | 3.6 | 0.09 | 0.019 | 0.007 | 0.000 | 0.044 | — |
| 25 | 0.05 | 3.4 | 0.11 | 0.004 | 0.006 | 0.008 | 0.011 | — |
| 26 | 0.04 | 3.8 | 0.14 | 0.011 | 0.007 | 0.008 | 0.015 | — |
| 27 | 0.07 | 3.3 | 0.13 | 0.022 | 0.006 | 0.007 | 0.008 | — |
| 28 | 0.08 | 3.4 | 0.14 | 0.036 | 0.006 | 0.006 | 0.013 | — |
| 29 | 0.06 | 3.2 | 0.14 | 0.044 | 0.006 | 0.005 | 0.012 | — |
| 30 | 0.05 | 3.4 | 0.10 | 0.021 | 0.002 | 0.004 | 0.011 | — |
| 31 | 0.06 | 3.3 | 0.13 | 0.020 | 0.004 | 0.008 | 0.017 | — |
| 32 | 0.07 | 3.5 | 0.11 | 0.019 | 0.007 | 0.008 | 0.015 | — |
| 33 | 0.06 | 3.4 | 0.10 | 0.020 | 0.018 | 0.008 | 0.019 | — |
| 34 | 0.07 | 3.4 | 0.12 | 0.020 | 0.023 | 0.006 | 0.014 | — |
| 35 | 0.06 | 3.5 | 0.11 | 0.020 | 0.006 | 0.002 | 0.017 | Sn: 0.02, Cr: 0.15, P: 0.006, V: 0.015, B: 0.0009, Bi: 0.007 |
| 36 | 0.07 | 3.4 | 0.12 | 0.019 | 0.008 | 0.006 | 0.019 | Ni: 0.03, Sn: 0.12, Cu: 0.15, Cr: 0.07, P: 0.01, Mo: 0.02 |
| 37 | 0.06 | 3.5 | 0.09 | 0.023 | 0.007 | 0.005 | 0.020 | Sb: 0.01, Sn: 0.23, P: 0.16, Mo: 0.07, V: 0.006 |
| 38 | 0.07 | 3.4 | 0.07 | 0.020 | 0.008 | 0.006 | 0.021 | Sb: 0.03, Cr: 0.04, P: 0.02, Mo: 0.01, B: 0.0009 |
| 39 | 0.08 | 3.5 | 0.05 | 0.023 | 0.009 | 0.005 | 0.017 | Sb: 0.03, Cu: 0.04, P: 0.01, Mo: 0.03, Nb: 0.003 |
| 40 | 0.08 | 3.2 | 0.13 | 0.019 | 0.007 | 0.009 | 0.018 | Sn: 0.12, Cu: 0.10, P: 0.02, Cr: 0.13, Mo: 0.02 |
| 41 | 0.07 | 3.3 | 0.12 | 0.020 | 0.007 | 0.005 | 0.019 | Ni: 0.20, Sn: 0.03, P: 0.05, Mo: 0.05, Zr: 0.03 |
| 42 | 0.06 | 3.6 | 0.10 | 0.020 | 0.008 | 0.002 | 0.017 | Sb: 0.05, Cu: 0.1, Mo: 0.02 |
| 43 | 0.05 | 3.8 | 0.11 | 0.022 | 0.007 | 0.003 | 0.020 | Ni: 0.13, Sn: 0.06, Cr: 0.27, P: 0.15, Bi: 0.31 |
| 44 | 0.04 | 3.3 | 0.08 | 0.028 | 0.008 | 0.004 | 0.022 | Sn: 0.44, Ni: 0.68, Cr: 0.17, P: 0.04, Zr: 0.0007 |
| 45 | 0.06 | 3.4 | 0.10 | 0.026 | 0.009 | 0.002 | 0.017 | Sb: 0.03, Cu: 0.10, P: 0.008, Mo: 0.01 |
| 46 | 0.07 | 3.2 | 0.11 | 0.027 | 0.008 | 0.007 | 0.016 | Sb: 0.03, Cu: 0.18, P: 0.02, Nb: 0.006 |
| 47 | 0.06 | 3.3 | 0.11 | 0.020 | 0.006 | 0.002 | 0.000 | Sn: 0.05, P: 0.006, Co: 0.004, Zn: 0.018 |
| 48 | 0.05 | 3.4 | 0.14 | 0.024 | 0.008 | 0.002 | 0.000 | Sn: 0.11, P: 0.005, Pb: 0.0004, W: 0.009 |
| 49 | 0.06 | 3.3 | 0.10 | 0.026 | 0.006 | 0.026 | 0.000 | Sn: 0.23, P: 0.005, As: 0.0013, Ge: 0.0047 |
| 50 | 0.07 | 3.2 | 0.12 | 0.018 | 0.008 | 0.034 | 0.000 | Sb: 0.03, P: 0.005, Co: 0.047, Ga: 0.0045 |
| 51 | 0.05 | 3.4 | 0.13 | 0.014 | 0.005 | 0.002 | 0.007 | Sb: 0.05, P: 0.06, Pb: 0.009, Zn: 0.0017 |
| 52 | 0.06 | 3.4 | 0.09 | 0.020 | 0.007 | 0.003 | 0.015 | Sb: 0.07, P: 0.007, Ge: 0.0003, As: 0.019 |
| 53 | 0.06 | 3.5 | 0.10 | 0.023 | 0.008 | 0.026 | 0.013 | Sb: 0.18, P: 0.005, W: 0.0020, Ga: 0.0002 |

| No. | Slab lateral face temperature T(° C.) at the start of rough rolling | $T_e$(° C.) | Maximum depth (mm) of edge cracks in hot-rolled sheet | Magnetic flux density $B_8$ (T) of product sheet | Remarks |
|---|---|---|---|---|---|
| 1 | 1274 | 1390 | 5 | 1.70 | Comparative Example |
| 2 | 1255 | 1392 | 4 | 1.91 | Invention Example |
| 3 | 1289 | 1388 | 5 | 1.90 | Invention Example |
| 4 | 1288 | 1394 | 3 | 1.90 | Invention Example |
| 5 | 1281 | 1396 | 4 | 1.69 | Comparative Example |
| 6 | 1267 | 1392 | 5 | 1.75 | Comparative Example |
| 7 | 1270 | 1392 | 3 | 1.91 | Invention Example |

TABLE 4-continued

| | | | | | |
|---|---|---|---|---|---|
| 8 | 1271 | 1394 | 4 | 1.90 | Invention Example |
| 9 | 1276 | 1392 | 5 | 1.90 | Invention Example |
| 10 | 1255 | 1390 | 3 | 1.58 | Comparative Example |
| 11 | 1294 | 1396 | 4 | 1.73 | Comparative Example |
| 12 | 1287 | 1394 | 3 | 1.91 | Invention Example |
| 13 | 1277 | 1392 | 5 | 1.90 | Invention Example |
| 14 | 1269 | 1392 | 5 | 1.91 | Invention Example |
| 15 | 1253 | 1396 | 4 | 1.66 | Comparative Example |
| 16 | 1252 | 1400 | 3 | 1.68 | Comparative Example |
| 17 | 1269 | 1400 | 5 | 1.91 | Invention Example |
| 18 | 1270 | 1392 | 4 | 1.92 | Invention Example |
| 19 | 1244 | 1253 | 4 | 1.90 | Invention Example |
| 20 | 1264 | 1178 | 37 | 1.72 | Comparative Example |
| 21 | 1255 | 1396 | 3 | 1.91 | Invention Example |
| 22 | 1240 | 1392 | 4 | 1.91 | Invention Example |
| 23 | 1267 | 1392 | 5 | 1.91 | Invention Example |
| 24 | 1287 | 1400 | 4 | 1.70 | Comparative Example |
| 25 | 1304 | 1392 | 4 | 1.83 | Comparative Example |
| 26 | 1284 | 1392 | 3 | 1.90 | Invention Example |
| 27 | 1277 | 1394 | 5 | 1.91 | Invention Example |
| 28 | 1280 | 1396 | 4 | 1.90 | Invention Example |
| 29 | 1266 | 1397 | 3 | 1.66 | Comparative Example |
| 30 | 1299 | 1398 | 4 | 1.81 | Comparative Example |
| 31 | 1259 | 1392 | 3 | 1.92 | Invention Example |
| 32 | 1309 | 1392 | 4 | 1.91 | Invention Example |
| 33 | 1254 | 1392 | 4 | 1.91 | Invention Example |
| 34 | 1288 | 1396 | 3 | 1.78 | Comparative Example |
| 35 | 1264 | 1400 | 5 | 1.94 | Invention Example |
| 36 | 1289 | 1396 | 2 | 1.93 | Invention Example |
| 37 | 1287 | 1397 | 3 | 1.93 | Invention Example |
| 38 | 1231 | 1396 | 2 | 1.93 | Invention Example |
| 39 | 1347 | 1397 | 4 | 1.93 | Invention Example |
| 40 | 1280 | 1390 | 3 | 1.94 | Invention Example |
| 41 | 1288 | 1397 | 5 | 1.93 | Invention Example |
| 42 | 1234 | 1400 | 4 | 1.93 | Invention Example |
| 43 | 1243 | 1399 | 3 | 1.94 | Invention Example |
| 44 | 1276 | 1398 | 3 | 1.93 | Invention Example |
| 45 | 1280 | 1400 | 2 | 1.93 | Invention Example |
| 46 | 1293 | 1394 | 4 | 1.93 | Invention Example |
| 47 | 1277 | 1395 | 3 | 1.95 | Invention Example |
| 48 | 1284 | 1394 | 3 | 1.94 | Invention Example |
| 49 | 1263 | 1319 | 2 | 1.94 | Invention Example |
| 50 | 1246 | 1327 | 3 | 1.94 | Invention Example |
| 51 | 1253 | 1397 | 3 | 1.94 | Invention Example |
| 52 | 1283 | 1393 | 2 | 1.95 | Invention Example |
| 53 | 1278 | 1328 | 3 | 1.94 | Invention Example |

The slab lateral face temperature T at the time of starting the hot rough rolling satisfied the condition $T \leq T_e$ with respect to the value $T_e$ calculated from the steel component of the slab in all the hot-rolled sheets shown in Tables. Moreover, since the slab heating satisfied the following conditions: the slag was heated until the slab surface temperature reached the range of 1100° C. to 1300° C.; held at the temperature: once cooled by an amount of the slab surface temperature in the range of 50° C. to 200° C.: heated until the slab surface temperature reached a temperature of 1300° C. or higher; and held at the temperature before the rough rolling was started, it is therefore observed that edge cracks can be prevented as the maximum depth of the edge crack that occurred in the edge part of the hot-rolled sheet was all 5 mm or less.

Next, to evaluate the magnetic properties of the final product sheet, the hot-rolled sheet was subjected to hot-band annealing by holding the sheet at the temperature of 1000° C. for 60 seconds and cooling with water from 800° C. to 350° C. at a rate of 50° C./s, followed by pickling to remove scales from the surface. The sheet was then cold rolled for the first time to achieve an intermediate sheet thickness of 1.8 mm and subjected to intermediate annealing by holding the sheet at 1100° C. for 100 seconds and cooling with water from 800° C. to 350° C. at a rate of 70° C./s followed by pickling again, and cold rolled for the second time to obtain a cold-rolled sheet with a final sheet thickness of 0.23 mm. The cold-rolled sheet was then subjected to primary recrystallization annealing also serving as decarburization annealing at 840° C. for 120 seconds, under a wet atmosphere containing $H_2$ and $N_2$ and having a dew point of 60° C., and then coated with an annealing separator mainly composed of MgO in an amount of 5 g/m$^2$ per surface and dried. Subsequently, the sheet was subjected to finishing annealing including causing secondary recrystallization and performing purification by holding the sheet at 1200° C. for 5 hours. In the finishing annealing, an atmosphere mainly composed of $H_2$ was used for the temperature range of 1050° C. or higher. After the unreacted annealing separator was removed from the surface of the steel sheet resulting from the finishing annealing, a phosphate-based insulation tension coating was coated thereon, and flattening annealing which also served as coating baking and steel sheet shape correction was carried out, obtaining a product sheet.

Test specimens for measuring magnetic properties were taken from both the innermost and outermost winding parts of a coil of the thus-obtained product sheet to measure the magnetic flux density $B_8$ at a magnetic force of 800 A/m according to the method defined by JIS C 2550-1 (2011). The lowest magnetic flux density value of each coil was determined as a coil-specific guaranteed value. Table 4 shows the measurement results as well. As seen from the results, all of the product sheets produced by using the slabs having the ingredient composition compliant with aspects of the present invention under the conditions compliant with aspects of the present invention exhibit an excellent magnetic flux density of $B_8 \geq 1.90$ T.

The invention claimed is:

1. A method for producing a grain-oriented electrical steel sheet comprising heating a steel slab having an ingredient composition containing C: 0.02 to 0.10 mass %, Si: 2.5 to 5.5 mass %, Mn: 0.01 to 0.30 mass %, S: 0.0010 to 0.040 mass %, Se: 0 to 0.040 mass %, sol. Al: 0.010 to 0.040 mass %, and N: 0.004 to 0.020 mass % with a remaining part comprising Fe and inevitable impurities;

hot rolling the slab;

subjecting the hot-rolled sheet to, optionally, hot-band annealing and then to one cold rolling or two or more cold rollings with an intermediate annealing between each cold rolling to form a cold-rolled sheet with a final sheet thickness;

subjecting the cold-rolled sheet to primary recrystallization annealing which also serves as decarburization annealing;

applying an annealing separator to the steel sheet surface; and subjecting the sheet to finishing annealing, characterized in that the slab is heated to 1300° C. or higher;

a slab lateral face temperature T when starting rough rolling during the hot rolling is equal to or lower than a temperature $T_e$ defined by Expression (1) presented below, $$T_e = -120000\,[\%\ S]^2 + 1400 \quad (1)$$

where [% S] denotes a S content (mass %) in the slab; and width reduction is carried out after at least one pass in the rough rolling.

2. The method for producing a grain-oriented electrical steel sheet according to claim 1, wherein the slab is heated until the slab surface temperature reaches a temperature of 1100 to 1300° C., held at the temperature for 0 to 300 min, cooled with a decrease amount in the slab surface temperature in the range of 50 to 200° C., heated until the slab surface temperature to 1300° C. or higher at a heating rate of 100° C./hr or more, and held at the temperature for 0 to 180 min.

3. The method for producing a grain-oriented electrical steel sheet according to claim 1, wherein the method comprises:

a hot rolling step comprising heating the steel slab, performing rough rolling of one or more passes in a temperature range from 1100° C. to $T_e$, performing finishing rolling of two or more passes in a temperature range from 800 to 1300° C. to obtain a hot-rolled sheet, and winding the sheet into a coil at a winding temperature of 400 to 750° C.; optionally, a hot-band annealing step comprising holding the hot-rolled sheet at a temperature from 800 to 1250° C. for 5 seconds or longer and then cooling the sheet from 800 to 350° C. at a rate of 5 to 100° C./s;

a cold rolling step comprising one cold rolling performed so that a total rolling reduction falls within the range of 50 to 92%, or comprising two or more cold rollings performed so that a total rolling reduction at the final cold rolling for obtaining the final sheet thickness falls within the range of 50 to 92%;

optionally, an intermediate annealing step comprising holding the sheet at a temperature from 800 to 1250° C. for 5 seconds or longer and then cooling the sheet from 800 to 350° C. at a rate of 5 to 100° C./s;

a primary recrystallization annealing step serving as decarburization annealing comprising holding the sheet at a temperature from 750 to 950° C. for 10 seconds or longer under a wet atmosphere containing $H_2$ and $N_2$ and having a dew point of 20 to 80° C.;

an annealing separator applying step comprising applying an annealing separator mainly composed of MgO to a surface of the steel sheet in an amount of 3 g/m$^2$ or more per surface; and a finishing annealing step that comprises purification by holding the sheet at a temperature of 1050° C. to 1300° C. for 3 hours or longer and that uses an $H_2$-containing atmosphere for a part of the temperature range of 800° C. or higher including at least the purification.

4. The method for producing a grain-oriented electrical steel sheet according to claim 1, wherein the steel slab contains, in addition to the above ingredient composition, at least one selected from Groups A to C below:

Group A: at least one selected from Ni: 0 to 1.00 mass %, Sb: 0 to 0.50 mass %, Sn: 0 to 0.50 mass %, Cu: 0 to 0.50 mass %, Cr: 0 to 0.50 mass %, P: 0 to 0.50 mass %, Mo: 0 to 0.50 mass %, Nb: 0 to 0.020 mass %, V: 0 to 0.010 mass %, B: 0 to 0.0025 mass %, Bi: 0 to 0.50 mass %, and Zr: 0 to 0.10 mass %:

Group B: at least one selected from Co: 0 to 0.0500 mass % and Pb: 0 to 0.0100 mass %; and Group C: at least one selected from As: 0 to 0.0200 mass %, Zn: 0 to 0.0200 mass %, W: 0 to 0.0100 mass %, Ge: 0 to 0.0050 mass %, and Ga: 0 to 0.0050 mass %.

5. The method for producing a grain-oriented electrical steel sheet according to claim 2, wherein the method comprises:

a hot rolling step comprising heating the steel slab, performing rough rolling of one or more passes in a temperature range from 1100° C. to $T_e$, performing finishing rolling of two or more passes in a temperature range from 800 to 1300° C. to obtain a hot-rolled sheet, and winding the sheet into a coil at a winding temperature of 400 to 750° C.; optionally, a hot-band annealing step comprising holding the hot-rolled sheet at a temperature from 800 to 1250° C. for 5 seconds or longer and then cooling the sheet from 800 to 350° C. at a rate of 5 to 100° C./s;

a cold rolling step comprising one cold rolling performed so that a total rolling reduction falls within the range of 50 to 92%, or comprising two or more cold rollings performed so that a total rolling reduction at the final cold rolling for obtaining the final sheet thickness falls within the range of 50 to 92%;

optionally, an intermediate annealing step comprising holding the sheet at a temperature from 800 to 1250° C. for 5 seconds or longer and then cooling the sheet from 800 to 350° C. at a rate of 5 to 100° C./s;

a primary recrystallization annealing step serving as decarburization annealing comprising holding the sheet at a temperature from 750 to 950° C. for 10 seconds or longer under a wet atmosphere containing $H_2$ and $N_2$ and having a dew point of 20 to 80° C.;

an annealing separator applying step comprising applying an annealing separator mainly composed of MgO to a surface of the steel sheet in an amount of 3 g/$m^2$ or more per surface; and a finishing annealing step that comprises purification by holding the sheet at a temperature of 1050° C. to 1300° C. for 3 hours or longer and that uses an $H_2$-containing atmosphere for a part of the temperature range of 800° C. or higher including at least the purification.

6. The method for producing a grain-oriented electrical steel sheet according to claim 2, wherein the steel slab contains, in addition to the above ingredient composition, at least one ingredient group selected from Groups A to C below:

Group A: at least one selected from Ni: 0 to 1.00 mass %, Sb: 0 to 0.50 mass %, Sn: 0 to 0.50 mass %, Cu: 0 to 0.50 mass %, Cr: 0 to 0.50 mass %, P: 0 to 0.50 mass %, Mo: 0 to 0.50 mass %, Nb: 0 to 0.020 mass %, V: 0 to 0.010 mass %, B: 0 to 0.0025 mass %, Bi: 0 to 0.50 mass %, and Zr: 0 to 0.10 mass %;

Group B: at least one selected from Co: 0 mass % to 0.0500 mass % and Pb: 0 mass % to 0.0100 mass %; and Group C: at least one selected from As: 0 mass % to 0.0200 mass %, Zn: 0 mass % to 0.0200 mass %, W: 0 mass % to 0.0100 mass %, Ge: 0 mass % to 0.0050 mass %, and Ga: 0 mass % to 0.0050 mass %.

7. The method for producing a grain-oriented electrical steel sheet according to claim 3, wherein the steel slab contains, in addition to the above ingredient composition, at least one ingredient group selected from Groups A to C below:

Group A: at least one selected from Ni: 0 to 1.00 mass %, Sb: 0 to 0.50 mass %, Sn: 0 to 0.50 mass %, Cu: 0 to 0.50 mass %, Cr: 0 to 0.50 mass %, P: 0 to 0.50 mass %, Mo: 0 to 0.50 mass %, Nb: 0 to 0.020 mass %, V: 0 to 0.010 mass %, B: 0 to 0.0025 mass %, Bi: 0 to 0.50 mass %, and Zr: 0 to 0.10 mass %;

Group B: at least one selected from Co: 0 mass % to 0.0500 mass % and Pb: 0 mass % to 0.0100 mass %; and Group C: at least one selected from As: 0 mass % to 0.0200 mass %, Zn: 0 mass % to 0.0200 mass %, W: 0 mass % to 0.0100 mass %, Ge: 0 mass % to 0.0050 mass %, and Ga: 0 mass % to 0.0050 mass %.

8. The method for producing a grain-oriented electrical steel sheet according to claim 5, wherein the steel slab contains, in addition to the above ingredient composition, at least one ingredient group selected from Groups A to C below:

Group A: at least one selected from Ni: 0 to 1.00 mass %, Sb: 0 to 0.50 mass %, Sn: 0 to 0.50 mass %, Cu: 0 to 0.50 mass %, Cr: 0 to 0.50 mass %, P: 0 to 0.50 mass %, Mo: 0 to 0.50 mass %, Nb: 0 to 0.020 mass %, V: 0 to 0.010 mass %, B: 0 to 0.0025 mass %, Bi: 0 to 0.50 mass %, and Zr: 0 to 0.10 mass %;

Group B: at least one selected from Co: 0 mass % to 0.0500 mass % and Pb: 0 mass % to 0.0100 mass %; and Group C: at least one selected from As: 0 mass % to 0.0200 mass %, Zn: 0 mass % to 0.0200 mass %, W: 0 mass % to 0.0100 mass %, Ge: 0 mass % to 0.0050 mass %, and Ga: 0 mass % to 0.0050 mass %.

* * * * *